US007419401B2

(12) United States Patent
Ferderer

(10) Patent No.: US 7,419,401 B2
(45) Date of Patent: Sep. 2, 2008

(54) TERMINAL CONTACT FOR ELECTRIC CONDUCTORS

(75) Inventor: Albert Ferderer, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/775,779

(22) Filed: Jul. 10, 2007

(65) Prior Publication Data

US 2008/0038964 A1 Feb. 14, 2008

(30) Foreign Application Priority Data

Aug. 8, 2006 (DE) ..... 20 2006 012 106 U

(51) Int. Cl.
*H01R 4/24* (2006.01)

(52) U.S. Cl. ..... 439/441

(58) Field of Classification Search ..... 439/441, 439/437–440

See application file for complete search history.

(56) References Cited

U.S. PATENT DOCUMENTS 5,632,645 A * 5/1997 Love ..... 439/441
5,807,133 A * 9/1998 Arnett ..... 439/418
6,336,824 B1 * 1/2002 Sorig ..... 439/441
6,752,667 B2 6/2004 Ferderer

FOREIGN PATENT DOCUMENTS

DE 101 45 324 4/2003

* cited by examiner

*Primary Examiner*—Gary F. Paumen
(74) *Attorney, Agent, or Firm*—Hayes Soloway P.C.

(57) ABSTRACT

The invention proposes a terminal contact for electric conductors in an insulating housing (1) with electric contacts that are arranged in separate chambers (11), wherein a clamping sleeve (3) is in axial alignment with and connected to a slide element (2) that is also arranged in the chambers (11).

A single-wire or multi-wire electric conductor that is inserted into a through-bore of the slide element and the clamping sleeve connected thereto is pushed over a stationary, rigid and barb-shaped terminal region of the conductor rail while the slide element is axially moved along the chamber, wherein the strands are clamped between the terminal region and the clamping sleeve.

7 Claims, 3 Drawing Sheets

TERMINAL CONTACT FOR ELECTRIC CONDUCTORS

BACKGROUND OF THE INVENTION

1. Field of the Invention

The invention pertains to a terminal contact for electric conductors in an insulating housing with electric contacts arranged in individual chambers.

A terminal contact of this type is required, in particular, for electric conductors that are realized in the form of stranded conductors.

2. Description of the Related Art

DE 101 45 324 C1 discloses an electric terminal element, the connecting end of which has a sawtooth-like structure, wherein a springable sleeve widened with the aid of a wedge can be pushed on this sawtooth-like structure.

SUMMARY OF THE INVENTION

The invention is based on the objective of developing a simple terminal contact, in which the connection of different types of electric conductors is realized with a few simple components and without tools, wherein the inventive terminal contact should be suitable for the broadest possible range of wire cross sections to be contacted.

This objective is attained in that the terminal contact consists of a conductor rail with a contacting region that is bent in a barb-shaped fashion opposite to the mating direction and surrounded by a clamping sleeve that is in axial alignment with and connected to a slide element featuring a through-bore for inserting an electric conductor, wherein this terminal contact is respectively arranged in an individual chamber of the connector housing, and wherein the slide element can be pushed over and pulled off the contacting region of the conductor rail such that a fixing force acts upon an electric conductor inserted between the contacting region and the clamping sleeve.

The advantages attained with the invention can be seen, in particular, in that it provides a toolless connection system for single-wire or multi-wire electric conductors, in which the conductors can be fixed on the terminal region of electric contacts by means of a springable sleeve. To this end, the connector housing contains a number of chambers, in which one respective clamping device for a standard conductor is arranged. The connector for electric conductors in the form of a clamping device consists of an axially displaceable slide element that can be pushed on the terminal region of an electric contact element of barb-like shape together with a clamping sleeve. One applicable prerequisite in this case, particularly for stranded conductors, is that their insertion into a contacting region takes place with zero insertion force so as to prevent individual wires from twisting or bending until a stopping point is reached.

During the installation, the stripped section of a stranded conductor is inserted into a bore extending through the slide element, as well as a clamping sleeve fixed on the slide.

The slide element is then axially displaced into the housing in the mating direction together with the stranded conductor.

In this case, it is advantageous that a slide element is prevented from unintentionally sliding off in the direction of the contact element by means of corresponding constructive measures, such as a guide wedge that frictionally slides in a groove in the chamber and the slide element.

As the slide element approaches its end position, the springably designed clamping sleeve is pushed over the barb-shaped contacting or terminal region together with the electric conductor.

The clamping sleeve that is advantageously provided with a continuous meander-shaped longitudinal slot ensures that the force of constriction exerted upon the terminal region is always adapted to the number and the size of the different types of the electric conductors.

Each slide element can once again be pried out of its respective chamber in order to release the electric conductor by inserting a flat narrow object, e.g., a screwdriver, into a bevel that is provided for this purpose on the outside of each chamber and extends into a recess in the slide element.

The insulating body may be realized in the form of a monobloc for plug-type connectors or in accordance with the segmental technique for terminal blocks.

In a monobloc, the easily fabricated conductor rail also needs to be connected to a socket or a pin connector such that a plug-type connector is realized with such a contacting or terminal region.

BRIEF DESCRIPTION OF THE DRAWINGS

One embodiment of the invention is illustrated in the figures and described in greater detail below. The figures show.

DETAILED DESCRIPTION OF THE PREFERRED EMBODIMENTS

Figure 1:
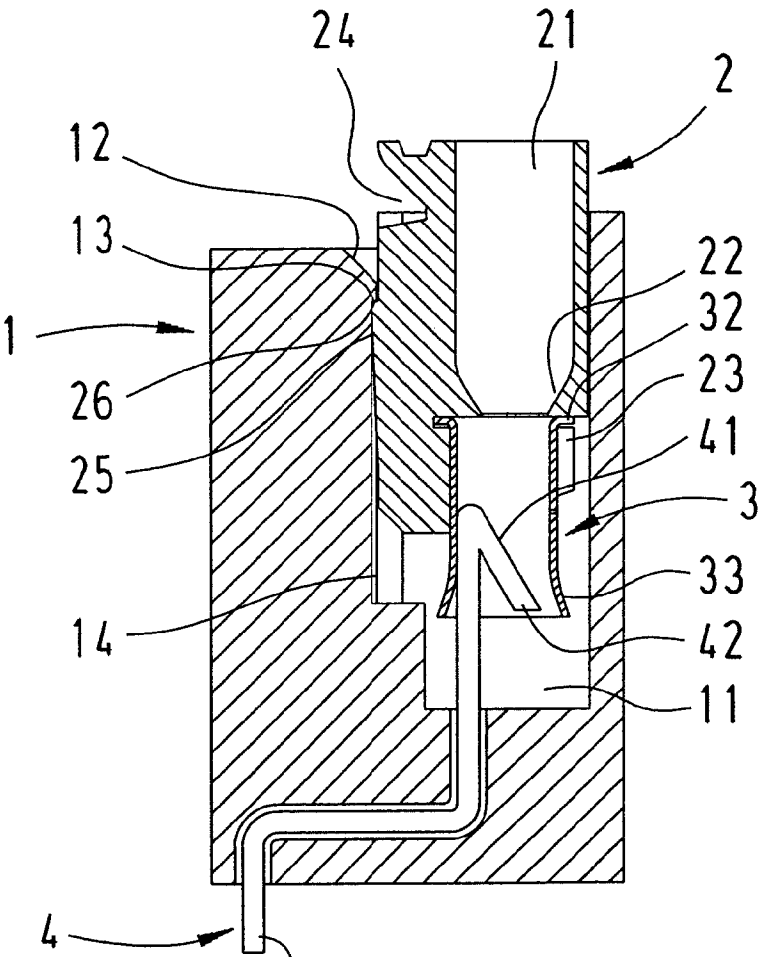
FIG. 1 a sectional representation of an insulating housing.

FIG. 1 shows a sectional representation of an insulating body 1, in a chamber 11 of which is arranged a displaceable slide element 2 with a clamping sleeve 3 connected thereto.

In addition, a conductor rail 4 is provided in the insulating body 1, wherein the contacting region 41 of said conductor rail is realized in the shape of a barb.

In this case, the conductor rail 4 is arranged in the insulating body 1 in such a way that the displaceable clamping sleeve 3 always encompasses the contacting region 41. In the opened installation state, in which the slide 2 protrudes out of the insulating housing 1 as far as possible, the barbed end 42 is approximately aligned with the funnel-shaped widening 33 such that a maximum slot opening is created for the zero force insertion of a stranded conductor extending through the through-bore 21 of the slide element. When the slide element is pressed into the insulating housing, the individual strands are increasingly pressed against the wall of the clamping sleeve 3 and fixed on the barbed end 42 that forms a clamping shoulder.

This applies analogously to the utilization of a single-wire electric conductor.

The slide element 2 is realized, in principle, in the form of a rectangular body with a through-bore 21 that features an inwardly narrowing funnel outlet 22.

In order to pry out a slide element 2 that was inserted into the insulating housing, e.g., by means of a screwdriver, the upper region of the insulating housing is provided with a bevel 12 and the slide features a corresponding wedge-shaped recess 24.

A slide guidance that is composed of an elongated wedge 25 on the slide and a guide groove 14 is provided underneath the wedge-shaped recess, wherein the guide groove ends with a projection 13 in the upper region of the insulating housing and the protruding wedge end 26 of the slide element comes in contact with said projection such that the slide is prevented from protruding and ultimately falling out of the insulating housing. The clamping sleeve 3 is held in a retaining groove 23 with the retaining ring 32 that is bent outward at a right angle, namely such that the center of the funnel is positioned about centrally to the barb-shaped connecting region 41 arranged thereunder referred to the right wall of the clamping sleeve 3 in this case.

Figure 2:
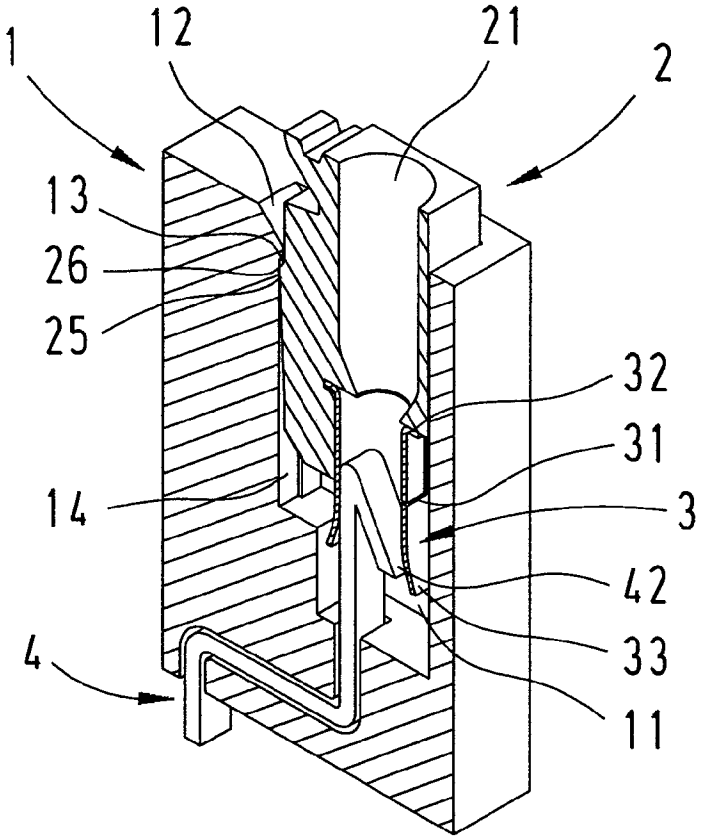
FIG. 2 an isometric section through the insulating housing.

FIG. 2 shows a sectioned perspective representation of the insulating housing 1 that is already illustrated in the form of a section in FIG. 1, namely with the slide element 2, the clamping sleeve 3 and the conductor rail 4.

The aforementioned guide groove 14, in which the slide guiding wedge 25 is guided, is also illustrated in this figure on the rear inner wall.

Figure 3:
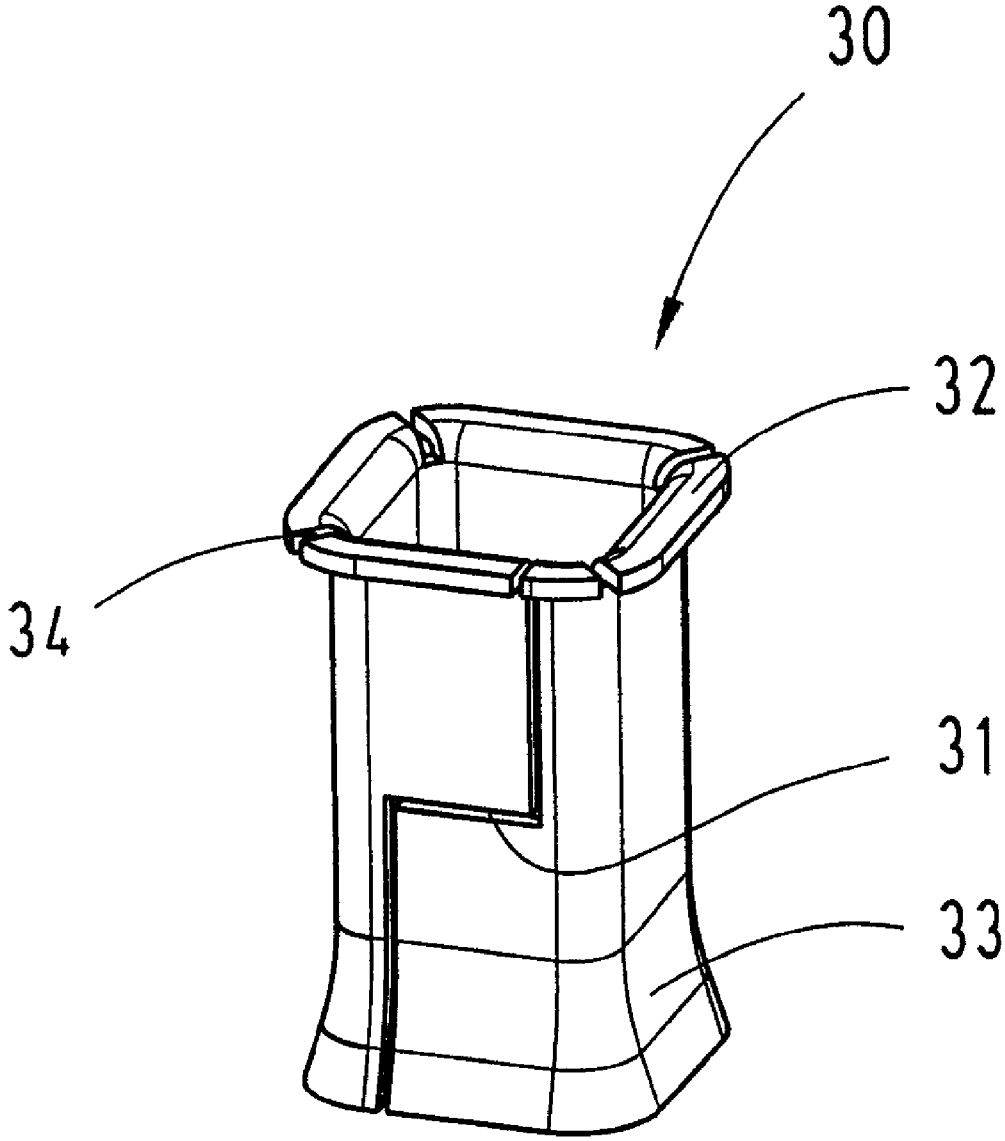
FIG. 3 a clamping sleeve.

The clamping sleeve 3 according to FIG. 3 is realized in the form of a springable rectangular clamping sleeve with a meander-shaped slot 31 along a sleeve wall such that the widening of said clamping sleeve by different types of electric conductors inserted into the slot between the barbed end 42 and the sleeve wall always results in a spring effect being realized when the slide element is lowered into the chamber of the insulating body.

In this case, one end is provided with a retaining edge 32 that is bent outward and interrupted several times by separating slots 34 while the opposite end features a funnel-shaped widening 33.

The conductor rail 4 illustrated in both FIGS. 1, 2 is respectively equipped with a circuit board connector end 43 and therefore also extends through the insulating housing 1 in angled form. In this case, these housings can also be butt-mounted.

However, it is also proposed to realize the terminal end in the form of a pin or socket contact or to connect the terminal end to a contact of this type such that a pluggable configuration is realized.

Figure 4:
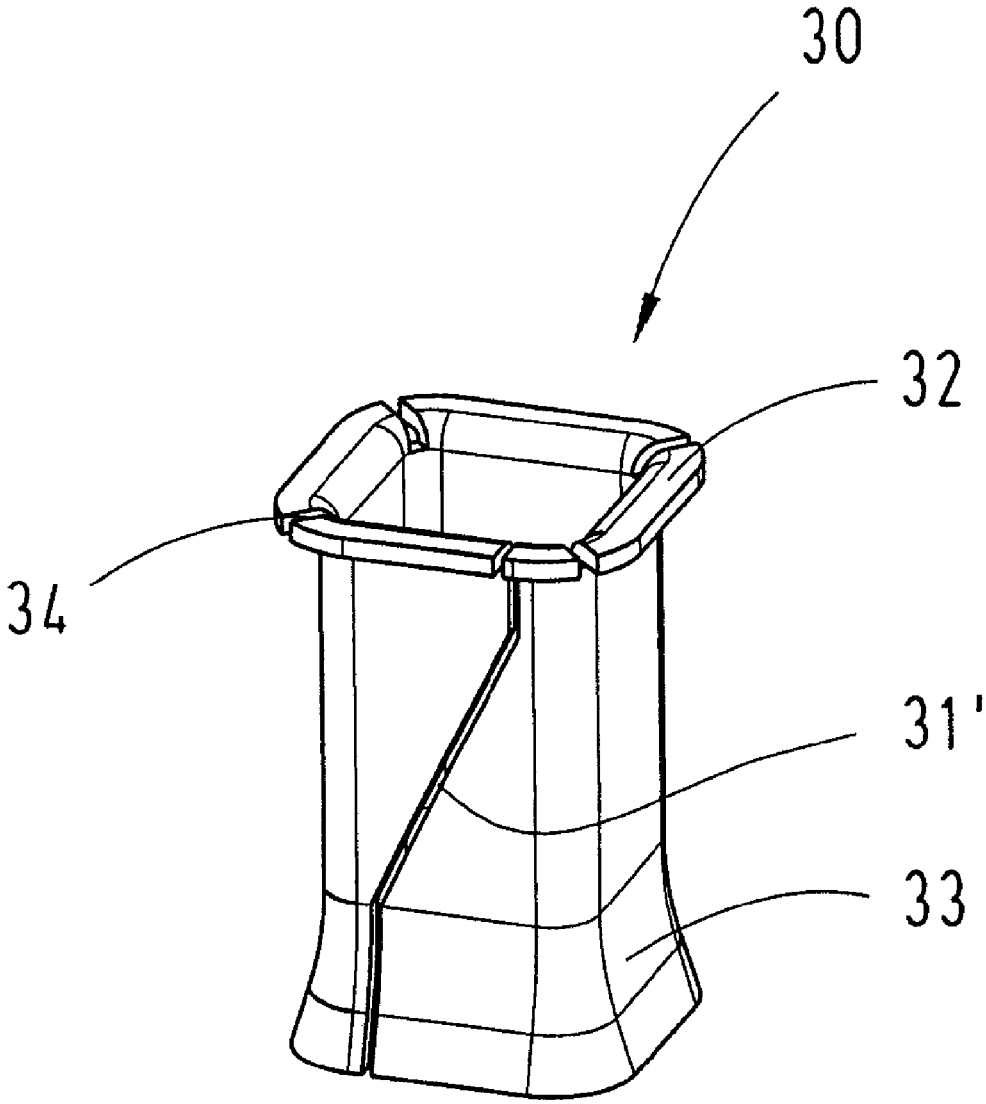
FIG. 4 another clamping sleeve.

FIG. 4 shows a another one of a clamping sleeve 3 wherein the meander-shaped slot is varied in a diagonal run of the slot 31'.

What is claimed is:

1. A terminal contact for electric conductors in an insulating housing with electric contacts arranged in individual chambers, comprising a conductor rail with a contacting region that is bent in a barb-shaped fashion opposite to the mating direction and surrounded by a clamping sleeve that is in axial alignment with and connected to a slide element featuring a through-bore for inserting an electric conductor, with this terminal contact being respectively arranged in an individual chamber of the insulating housing, wherein the slide element can be pushed over and pulled off the contacting region of the conductor rail such that a fixing force acts upon an electric conductor inserted between the contacting region and the clamping sleeve.

2. The terminal device according to claim 1, wherein the clamping sleeve of square shape features a meander-shaped longitudinal slot, as well as a retaining ring that is bent outward and slotted several times on one open end and a funnel-shaped widening on the other open end.

3. The terminal device according to claim 1, wherein the clamping sleeve of square shape feature a diagonal run of the slot.

4. The terminal device according to claim 1, wherein a fork-shaped retaining element for receiving the retaining ring of the clamping sleeve is provided on the slide element.

5. The terminal device according to claim 1, wherein the displaceable slide element can be pried out of the insulating housing by means of a tool that engages into a recess.

6. The terminal device according to claim 1, wherein the conductor rail is provided with a circuit board connector end.

7. The terminal device according to claim 5, wherein the conductor rail is provided to connect a male or female connector.

* * * * *